United States Patent [19]

Conn

[11] 4,189,072

[45] Feb. 19, 1980

[54] CONTAINER WITH NOZZLE AND/OR DRINKING TUBE AND CLOSURE MEANS

[76] Inventor: John L. Conn, P.O. Box 4501-Station B, Spartanburg, S.C. 20303

[21] Appl. No.: 956,222

[22] Filed: Oct. 30, 1978

[51] Int. Cl.[2] ..... B67D 3/00; B67D 5/06

[52] U.S. Cl. ..... 222/519; 222/539; 222/568; 220/85 SP

[58] Field of Search ..... 229/7 S; 220/85 SP; 222/538, 539, 568, 519

[56] References Cited

U.S. PATENT DOCUMENTS

| | | | |
|---|---|---|---|
| 2,403,299 | 7/1946 | Pickin | 222/519 X |
| 3,658,218 | 4/1972 | Krautkramer | 222/568 X |

FOREIGN PATENT DOCUMENTS

| | | | |
|---|---|---|---|
| 566472 | 11/1958 | Canada | 220/85 SP |

*Primary Examiner*—George T. Hall

[57] ABSTRACT

The construction of a container with a closure means wherein the closure means assembly will serve as a nozzle; as a drinking tube; and as a closure means.

1 Claim, 2 Drawing Figures

CONTAINER WITH NOZZLE AND/OR DRINKING TUBE AND CLOSURE MEANS

SUMMARY OF THE INVENTION

The present invention generally relates to a beverage container and drinking tube and having a closure means for sealing the container wherein said has the added ability to also serve as a nozzle and container's closure means.

The principal objects of the present invention are;

To provide a drinking tube for use with a beverage container and having a container's closure means as integral parts of said tube wherein an upper portion of the drinking tube will seal a container and an additional upper portion of the drinking tube will extend upwardly above the lid of the container for access thereto so the liquid contents of the container may be consumed through the drinking tube in a conventional siphoning manner.

To provide such a drinking tube and beverage container having means to seal said drinking tube's exterior end with a closure cap so to seal and cover the drinking tube and also keep sanitary.

To provide a container and nozzle wherein the nozzle will serve as the container's closure means wherein said nozzle will also serve as an operative nozzle for the container.

To provide such a container and nozzle and/or drinking tube with a means of storing said nozzle and drinking tube inside a container and closure cap.

To provide a complete container, a complete nozzle, a complete drinking tube and a closure means that can be made from molded plastic or the like.

To provide such a container and nozzle and/or drinking tube which is economical to manufacture, simple in construction, easy to use, and particularly well adapted for the purpose intended.

Other objects and advantages of this invention will become apparent from the following description taken in connection with the accompanying drawings wherein are set forth by way of illustration an example certain embodiments of this invention.

BACKGROUND OF THE INVENTION

Closures have been known where the closure means will form a nozzle but with the use of auxiliary closure caps to form a nozzle closure and are not suitable to also form an operative drinking tube.

Applicant proposes to thus construct a closure means for a container that will serve as a closure; as a nozzle; and as a drinking tube wherein the closure means, and the nozzle, and the drinking tube is of one integral assembly.

DETAILED DESCRIPTION OF THE PRESENTLY PREFERRED EMBODIMENTS

Figure 4:
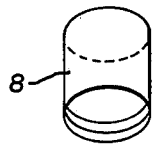
FIG. 4 is a view of the nozzle's and/or drinking tube's closure cap that is used to seal said and also to keep the drinking tube sanitary and to protect this exterior end from damage during shipment.
Figure 1:
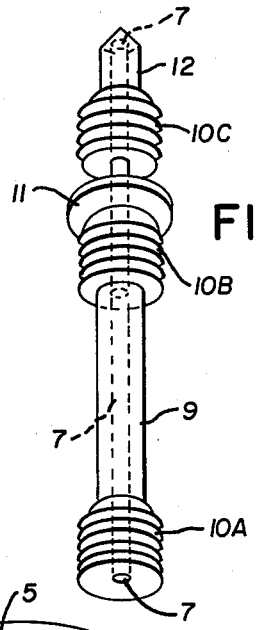
FIG. 1 is a perspective view of a nozzle and/or drinking tube embodying features to seal a container, to construct a drinking tube, and to construct a nozzle all in the one integral assembly.
Figure 2:
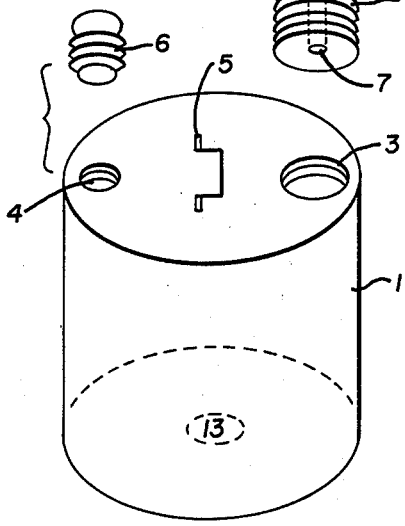
FIG. 2 is a view of a hollow container which is larger than the one serving container that is normally used with a nozzle attachment wherein said container has an aperture so to house said nozzle and closure means with also an air intake hole and closure means for said air intake hole, and also a handle assembly.
Figure 3:
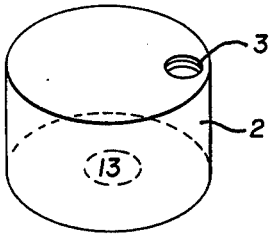
FIG. 3 is a view of one serving hollow container which is normally used with a drinking tube wherein said container has an aperture so to house said drinking tube and closure means.

Referring more in detail to the drawings where the reference numeral (2) generally designates a one serving beverage container (FIG. 3) that is constructed from such material, such as molded plastic or the like wherein number (1) of FIG. 2 generally designates a larger than one serving container that is normally used with a nozzle (FIG. 1).

Note: Be it stated that this complete invention may be constructed from molded plastic or the like.

Now to discuss the beverage or one serving container (2) wherein the container is filled at the container's aperture (3) with liquid contents (13) and then the container (2) is sealed by screw connecting (10 A) completely through the container's aperture (3) and then proceeding to extend said drinking tube's smaller portion (9) down into said container's (2) aperture (3) so to screw connect the threaded area (10 B) to aperture (3) wherein the washer (11) will help to seal said and proceed then to screw connect the closure cap (8) over the tube's mouth end area (12) wherein the internal threads of the closure cap (8) will screw connect to cover and seal said drinking tube's end (12) by screw connecting to the tube (FIG. 1) at the externally threaded area (10 C) to complete said assembly.

To drink the contents (13) of this sealed beverage container (2) and drinking tube (FIG. 1) is accomplished by removing the closure cap (8) and proceed to consume contents (13) as per the common drinking straw method wherein contents (13) will be dispensed at the tube's hole (7) wherein said container and drinking tube may be disposed thereof.

To discuss the one serving container (2) as applied to the common one quart oil container wherein said assembly (FIG. 3) and (FIG. 1) will serve to seal said container and will serve to be a container (2) with a nozzle (FIG. 1). In this application the nozzle (FIG. 1) is made useable by removing the closure cap (8) and then reverse-screw the closure means (10 B) by usung the rectangular shaped end area or mouth piece (12) with your fingers so to unscrew this connection (10 B) at (3) and then proceed to pull out the smaller nozzle's section (9) and then reverse-screw this connection to seal the externally threaded end of the nozzle (10 A) to the container (2) at aperture (3) and then proceed to use as a container and nozzle wherein said assembly may be disposed thereof after use.

To discuss the larger container (FIG. 2) wherein this container has a handle (5) and an air intake aperture (4) and closure means (6) wherein the container (1) is sealed by screw connecting the nozzle (FIG. 1) at connection (3 and 10 B) and proceed to seal assembly by screw connecting the closure cap (8) to the externally threaded area (10 C) of the nozzle.

To pour out the contents (13) will be as previously stated to construct a nozzle.

Be it stated that when manufactured to be used only as a drinking tube that the attachment (10 A) may be deleted from assembly.

It is understood that various changes may be made in the detail construction, that such changes will be within the spirit and scope of the present invention as is defined by the claim.

This application contains one claim.

What is claimed:

1. The construction of a container with nozzle and/or drinking tube with closure means wherein the construction of a hollow container having a bottom, side walls and a top wherein the top surface area of said container has constructed an internally threaded aperture through the top surface at a point near the surface's outer area near the peripheral wall and having another smaller internally threaded aperture through this top surface and closure means at an opposite top surface point near the peripheral wall wherein said container contains a centrally top surface mounted handle wherein the construction of a nozzle and/or drinking tube having an internal longitudinal aperture completely through the central area of said nozzle or drinking tube wherein the one end of said nozzle or tube has an externally threaded area equal in circumference and having similar thread fits as said container's larger internally threaded aperture wherein an adjacent extended central portion of said nozzle or tube is of a smaller un-threaded circumference than that of the container's internally threaded larger aperture wherein an adjacent externally threaded area is constructed upon said nozzle equal in circumference and similar thread fits as said container's larger internally threaded aperture wherein this portion of the nozzle is equal in length as that of the height of the inside of said container wherein adjacent to this second externally threaded area is constructed a thin washer having a larger circumference than that of the larger container's internally threaded aperture wherein adjacent to this washer is constructed a third externally threaded area equal to the first and second in circumference and of like threads wherein adjacent to this third externally threaded area is constructed a smaller extended rectangular shaped mouth piece or end that is smaller in circumference than that of the third externally threaded area wherein all nozzle or tube components are of one continuous integral assembly wherein the construction of a closure cap that is internally threaded and having like thread fits as the third externally threaded area wherein said closure cap will cover the rectangular mouth or end piece so to seal aperture at the nozzle's or drinking tube's end.

* * * * *